US008529110B2

(12) United States Patent
Tsukamoto

(10) Patent No.: US 8,529,110 B2
(45) Date of Patent: Sep. 10, 2013

(54) VEHICULAR LAMP AND VEHICULAR LAMP ASSEMBLY METHOD

(75) Inventor: Hironori Tsukamoto, Shizuoka (JP)

(73) Assignee: Koito Manufacturing Co., Ltd., Tokyo (JP)

( * ) Notice: Subject to any disclaimer, the term of this patent is extended or adjusted under 35 U.S.C. 154(b) by 295 days.

(21) Appl. No.: 13/109,723

(22) Filed: May 17, 2011

(65) Prior Publication Data

US 2011/0280034 A1 Nov. 17, 2011

(30) Foreign Application Priority Data

May 17, 2010 (JP) ..... 2010-113109

(51) Int. Cl.
*F21S 8/10* (2006.01)

(52) U.S. Cl.
USPC ..... 362/544; 362/543; 362/546; 362/548; 362/549

(58) Field of Classification Search
USPC ..... 362/543, 544, 546, 548, 549
See application file for complete search history.

(56) References Cited

U.S. PATENT DOCUMENTS 4,423,475 A * 12/1983 Bartl ..... 362/544
4,459,644 A * 7/1984 Bailly ..... 362/543
4,774,637 A * 9/1988 Budde et al. ..... 362/548
6,045,247 A * 4/2000 Fukuhara ..... 362/543
6,575,612 B2 * 6/2003 Kageyama et al. ..... 362/544
7,604,386 B2 * 10/2009 Rawlings et al. ..... 362/548

FOREIGN PATENT DOCUMENTS

CN 101358701 A 2/2009
JP 59-152503 U 10/1984

OTHER PUBLICATIONS

Office Action for Chinese Application No. 201110127900.9 dated Feb. 17, 2013, with English translation thereof (15 pages).
Espacenet, Patent Abstract for Chinese Publication No. 101358701 published Feb. 4, 2009 (1 page).

* cited by examiner

*Primary Examiner* — Stephen F Husar
*Assistant Examiner* — James Cranson, Jr.
(74) *Attorney, Agent, or Firm* — Osha Liang LLP

(57) ABSTRACT

A vehicular lamp has a plurality of bulb sockets, each of the plurality of bulb sockets holding a bulb serving as a light source, a lamp body that accommodates the bulb sockets, a front cover that forwardly covers the lamp body, a plurality of bulb socket fixing portions formed in the lamp body, and inserted with the plurality of bulb sockets, a temporary holding member that includes a plurality of temporary holding portions of the bulb sockets, and temporarily holds each of the plurality of bulb sockets to each of the plurality of temporary holding portions, and a bulb socket mounting unit that sandwiches the lamp body and the temporary holding member via an elastic portion formed on each of the bulb sockets. The elastic portion elastically deforms when the temporarily held bulb sockets are inserted into the fixing portions and returning at predetermined fixing positions of the fixing portions.

6 Claims, 9 Drawing Sheets

VEHICULAR LAMP AND VEHICULAR LAMP ASSEMBLY METHOD

BACKGROUND OF INVENTION

1. Field of the Invention

The present invention relates to a vehicular lamp with easy assembly of a bulb serving as a light source, and a vehicular lamp assembly method.

2. Related Art

Patent Document 1 illustrates an attachment structure of a bulb serving as a light source of a vehicular lamp. In the vehicular lamp according to Patent Document 1, a back cover to which a plurality of light source bulbs is fixed is inserted into an insertion opening of a lamp body, thus attaching the light source bulbs to an internal portion of the vehicular lamp.

[Patent Document 1] Japanese Utility Model Application Publication No. 559-152503

SUMMARY OF INVENTION

In the vehicular lamp according to Patent Document 1, because the plurality of bulbs must first be fixed to the back cover by screwing or the like, the operation of attaching the bulbs to the back cover takes time and work. A bulb filament is designed so as to be disposed at a predetermined position on a reflective surface formed on the lamp body when the bulb is fixed to the lamp body via the back cover. However, in the vehicular lamp according to Patent Document 1, positional displacement between the back cover and the lamp body may occur due to the mold precision, assembly precision, thermal deformation, and the like. In such cases, the position of the bulb also becomes displaced with respect to the insertion opening of the lamp body. As a consequence, the relative position accuracy between the bulb filament and the reflective surface is low.

In one or more embodiments, the present invention provides a vehicular lamp with an easy assembly operation for a bulb serving as a light source, a low assembly cost, and a high position accuracy of the bulb with respect to a bulb attachment portion. In one or more embodiments, the present invention provides a vehicular lamp assembly method.

A vehicular lamp according to one or more embodiments of the present invention includes a plurality of bulb sockets, each of the plurality of bulb sockets holding a bulb serving as a light source; a lamp body that accommodates the bulb sockets; and a front cover that forwardly covers the lamp body. The vehicular lamp further includes a plurality of bulb socket fixing portions formed in the lamp body, and inserted with the plurality of bulb sockets; a temporary holding member that includes a plurality of temporary holding portions of the bulb sockets, and temporarily holds each of the plurality of bulb sockets to each of the plurality of temporary holding portions; and a bulb socket mounting unit that sandwiches the lamp body and the temporary holding member via an elastic portion formed on each of the bulb sockets. The elastic portion elastically deforming when the temporarily held bulb sockets are inserted into the fixing portions and returning at predetermined fixing positions of the fixing portions.

(Operation) By temporarily holding, but not fixing, the bulb socket, the temporary holding member can be easily attached with a plurality of bulb sockets in a short time. When the temporarily held bulb sockets are fixed to the lamp body, the elastic portion of each of the bulb sockets is elastically deformed to an insertable position at which the bulb sockets can be inserted into the fixing portions of the lamp body. In addition, when the bulb sockets are inserted up to the predetermined fixing positions of the fixing portions, the elastic portion returns to its original position and sandwiches the lamp body and the temporary holding member. Therefore, the plurality of bulb sockets is positioned by the fixing portions of the lamp body, and can be easily and swiftly attached to the lamp body via the temporary holding member in a one-touch manner.

According to one or more embodiments of the present invention, in the vehicular lamp described above, the bulb socket mounting means has, on each of the bulb sockets, a biasing unit that biases both the lamp body and the temporary holding member toward the elastic portion at the predetermined fixing positions of the fixing portions.

(Operation) When the bulb sockets are inserted up to the fixing positions of the fixing portions of the lamp body, the biasing unit of each of the bulb sockets biases both the lamp body and the temporary holding member toward the elastic portion of the bulb sockets, whereby the lamp body and the temporary holding member are held between the elastic portion and the biasing means. Therefore, the bulb sockets are positioned and fixed by both the lamp body and the temporary holding member.

According to one or more embodiments of the present invention, in the vehicular lamp described above, an integrated connector that integrates and is connected to the plurality of bulb sockets is disposed on the temporary holding member.

(Operation) Wires to each bulb socket are integrated into one connector. Therefore, the operation to attach a power cable during attachment or replacement of the bulb socket can be easily and swiftly performed.

A vehicular lamp according to one or more embodiments of the present invention includes a plurality of bulb sockets, each of the plurality of bulb sockets holding a bulb serving as a light source; a lamp body that accommodates the bulb sockets; and a front cover that forwardly covers the lamp body. The vehicular lamp further includes a temporary holding member that includes a plurality of temporary holding portions of the bulb sockets, and temporarily holds each of the plurality of bulb sockets to each of the plurality of temporary holding portions; and a plurality of bulb socket fixing portions formed in the lamp body, and inserted with the plurality of bulb sockets. The plurality of bulb socket temporary holding portions of the temporary holding member is formed at a position that generally matches the plurality of bulb socket fixing portions.

(Operation) The plurality of bulb sockets corresponding to the plurality of fixing portions of the lamp body can thus be easily inserted without adjusting the orientation of the bulb sockets temporarily held to the temporary holding member.

An assembly method according to one or more embodiments of the present invention is for a vehicular lamp that includes a plurality of bulb sockets, each of the plurality of bulb sockets holding a bulb serving as a light source; a lamp body that accommodates the bulb sockets; and a front cover that forwardly covers the lamp body. The assembly method includes a first step in which the plurality of bulb sockets is temporarily held to a temporary holding member that is formed with a plurality of temporary holding portions of the bulb sockets; a second step in which the plurality of bulb sockets temporarily held to the temporary holding member is inserted into a plurality of fixing portions provided in the lamp body, while elastically deforming an elastic portion provided on each of the bulb sockets; and a third step in which the lamp body and the temporary holding member are sandwiched via the elastic portion that returns to an original position thereof at predetermined fixing positions of the fixing portions.

(Operation) The assembly operation of the bulb sockets is easily performed in a one-touch manner in a short time by temporarily holding the plurality of bulb sockets to the temporary holding member, and by using the elastic portion of each of the bulb sockets that sandwiches the lamp body and the temporary holding member at an insertion position of a bulb unit with respect to the fixing portions of the lamp body. Consequently, the bulb sockets are positioned by the fixing portions of the lamp body.

According to one or more embodiments of the present invention, the assembly operation of bulb sockets holding bulbs serving as light sources is easily and swiftly performed, the assembly cost is reduced, and the position accuracy of a bulb with respect to a bulb attachment portion is improved.

According to one or more embodiments of the present invention, the bulb sockets are more strongly fixed to a lamp body, and the position accuracy of the bulb sockets with respect to the lamp body is further improved.

According to one or more embodiments of the present invention, the assembly operation of the sockets of bulb sockets holding bulbs serving as light sources can be more easily and swiftly performed, and the assembly cost is reduced.

According to one or more embodiments of the present invention, the assembly operation of the plurality of bulb sockets can be easily and swiftly performed, and the assembly cost is reduced.

According to one or more embodiments of the present invention, the assembly operation of the sockets of bulb sockets holding bulbs serving as light sources is easily and swiftly performed, the assembly cost is reduced, and the position accuracy of the bulb with respect to the bulb attachment portion of the lamp body is improved.

Other aspects and advantages of the invention will be apparent from the following description, the drawings and the claims.

DETAILED DESCRIPTION

Figure 1:
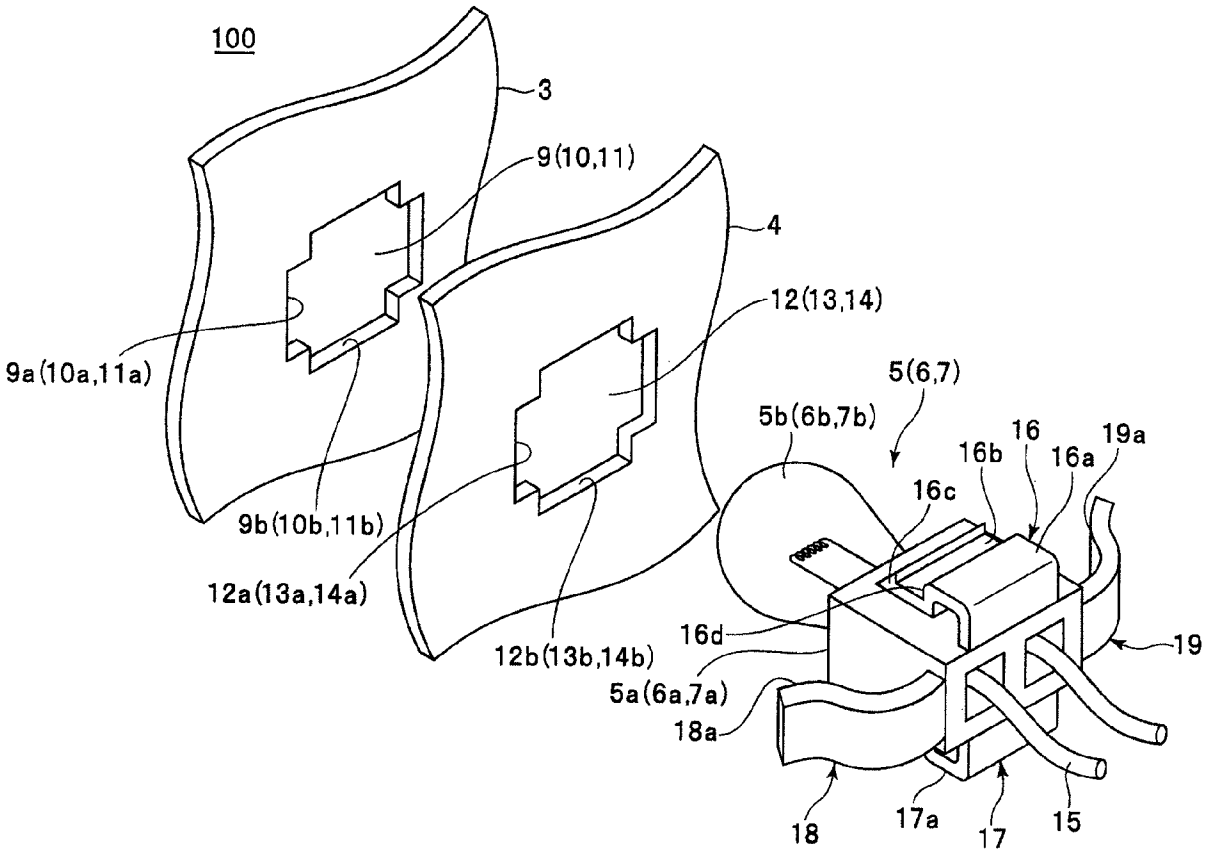
FIG. 1 is an exploded perspective view that shows a bulb socket, a temporary holding portion of a temporary holding member, and a fixing portion of a lamp body in a vehicular lamp according to a first embodiment.

Next, embodiments of a vehicular lamp according to the present invention will be described, based on FIGS. 1 to 6. In the following detailed description of embodiments of the invention, numerous specific details are set forth in order to provide a more thorough understanding of the invention. However, it will be apparent to one of ordinary skill in the art that the invention may be practiced without these specific details. In other instances, well-known features have not been described in detail to avoid unnecessarily complicating the description. Like elements in the various figures are denoted by like reference numerals for consistency.

Figure 3:
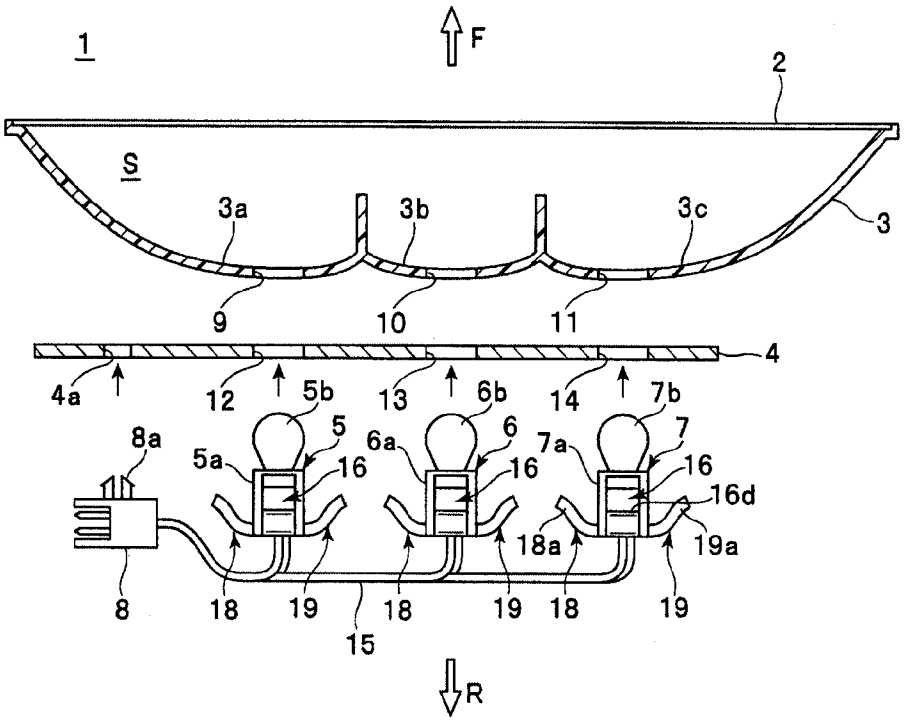
FIG. 3 is an exploded cross-sectional view of the vehicular lamp according to the first embodiment.

A vehicular lamp 1 of the first embodiment includes a front cover 2 formed of a transparent resin or the like, a resin lamp body 3, a temporary holding member 4, and a plurality of bulb sockets (5 to 7) serving as a light source. The front cover 2 is integrated with the lamp body 3 so as to define a lamp chamber S on an inner side of the lamp body 3. If the front cover 2 side is the vehicle forward direction (direction of a reference symbol F) and the lamp body 3 side is the vehicle rearward direction (direction of a reference symbol R) as shown in FIG. 3, the temporary holding member 4 is disposed behind the rear of the lamp body 3. The temporary holding member 4 temporarily holds the plurality of bulb sockets (5 to 7), and is mounted with an integrated connector 8.

Fixing portions (9 to 11) that are through holes having the same general cross shape are provided at predetermined intervals that correspond to respective predetermined attachment positions of the plurality of bulb sockets (5 to 7) in the lamp body 3. Around the fixing portions (9 to 11) on the inner side of the lamp body 3, reflective surfaces (3*a* to 3*c*) are formed that reflect light radiated from the respectively attached bulb sockets (5 to 7) in a predetermined direction ahead of the vehicle.

The temporary holding member 4 is a plate-shaped member formed of metal, resin, or the like. The temporary holding member 4 can be inexpensively made if formed of metal, and the temporary holding member 4 can be made lightweight if formed of resin. In addition, the temporary holding member 4 shown in FIG. 2 shaped as a flat plate is formed with temporary holding portions (12 to 14) for the bulb sockets (5 to 7) at positions that correspond to the fixing portions (9 to 11) of the lamp body 3, and further formed with an attachment portion 4*a* for the integrated connector. The temporary holding portions (12 to 14) are through holes having the same general size and cross shape as the fixing portion (9 to 11), and formed at the same intervals as the fixing portions (9 to 11). The integrated connector attachment portion 4*a* is a penetrating square hole.

Figure 2:
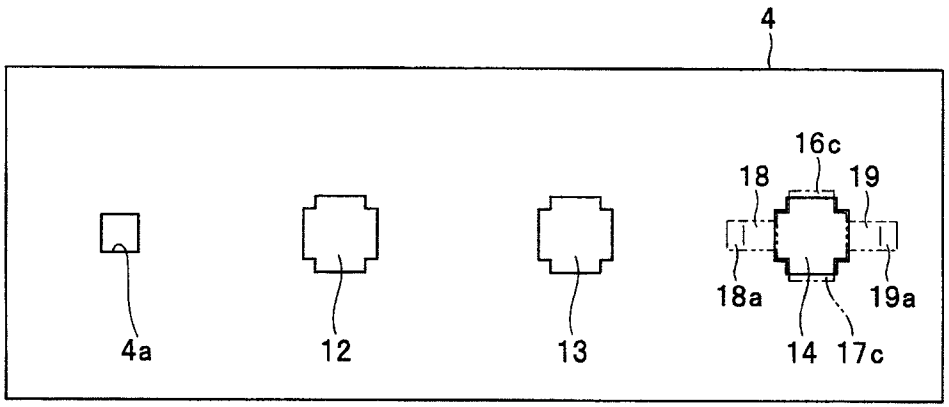
FIG. 2 is a frontal view of the temporary holding member.

Note that the temporary holding member 4 according to the first embodiment is formed into a flat plate shape as shown in FIG. 2 with the attachment positions of the bulb sockets (5 to 7) in the lamp body 3 aligned in the front-rear direction. However, in the event of front-rear displacement of the attachment positions of the bulb sockets (5 to 7), by providing a portion stepped in the front-rear direction on the temporary holding member 4 based on the back surface contour of the lamp body 3, the positions of the temporary holding portions (12 to 14) in the front-rear direction are formed aligned with the positions of the fixing portions (9 to 11) in the front-rear direction.

The bulb sockets (5 to 7) are respectively configured from bulb socket bodies (5*a* to 7*a*) that are made of resin and have the same shape, and bulbs (5*b* to 7*b*) that are supported on the front ends of the bulb socket bodies (5*a* to 7*a*). The bulb sockets (5 to 7) are each connected to the integrated connector 8 by a cable 15 that extends from behind the bulb socket bodies (5*a* to 7*a*). The integrated connector 8 has, at a front end, a square lance portion 8*a* that is inserted and fixed to the integrated connector attachment portion 4*a* of the temporary holding member 4.

A pair of concave-convex lance portions (16, 17) are integratedly provided on the top and bottom sides of each bulb socket body (5*a* to 7*a*), and a pair of biasing plate springs (18, 19) are integratedly provided on the right and left sides of each bulb socket body (5*a* to 7*a*). Note that, in the first embodiment, the concave-convex lance portions (16, 17) and the pair of biasing plate springs (18, 19), in cooperation with the temporary holding member having the temporary holding portions (12 to 14) and the fixing portions (9 to 11) of the lamp body 3, constitute bulb socket mounting means 100 in FIG. 1.

The concave-convex lance portions (16, 17) are respectively formed by integrating convex portions (16*a*, 17*a*) that curve forward and respectively extend upward and downward from the rear end portion of the respective upper surface and lower surface of each bulb socket body (5*a* to 7*a*), concave portions (16*b*, 17*b*) that are forward of the convex portions (16*a*, 17*a*) and respectively recess downward and upward, and return portions (16*c*, 17*c*) that are forward of the concave portions (16*b*, 17*b*).

The horizontal width of the bulb socket bodies (5*a* to 7*a*) is formed as generally similar to the width of horizontal holes (9*a* to 11*a*) of the fixing portions (9 to 11). The height of the bulb socket bodies (5*a* to 7*a*) is formed as higher than that of the horizontal holes (9*a* to 11*a*) of the fixing portions (9 to 11). The distance from the upper surface of the concave portion 16*b* to the lower surface of the concave portion 17*b* is formed as generally similar to the height of vertical holes (9*b* to 11*b*) of the fixing portions (9 to 11). Consequently, when attached to the fixing portions (9 to 11), the bulb sockets (5 to 7) are positioned in the up, down, left, and right directions with respect to the lamp body 3 by fitting the bulb socket bodies (5*a* to 7*a*) into the fixing portions (9 to 11).

Note that the horizontal width of horizontal holes (12*a* to 14*a*) of the temporary holding portions (12 to 14) is slightly wider than the horizontal width of the horizontal holes (9*a* to 11*a*) of the fixing portions (9 to 11), and the height of vertical holes (12*b* to 14*b*) is slightly higher than that of the vertical holes (9*b* to 11*b*). Consequently, the bulb sockets (5 to 7) inserted into the temporary holding portions (12 to 14) form a minute clearance with the temporary holding portions (12 to 14) as shown in FIG. 2, and the bulb sockets (5 to 7) are temporarily held to the temporary holding portions (12 to 14) by disposing the concave portions (16*b*, 17*b*) in the vertical holes (12*b* to 14*b*).

The front-rear length of the concave portions (16*b*, 17*b*) is formed as generally similar to the total thickness of the lamp body 3 and the temporary holding member 4. Consequently, when the bulb sockets (5 to 7) are inserted into the fixing portions (9 to 11) and the temporary holding portions (12 to 14), the concave portions (16*b*, 17*b*) sandwich the opening peripheral edge portions of the fixing portions (9 to 11) and the temporary holding portions (12 to 14). Therefore, the bulb sockets (5 to 7) are positioned in the front-rear direction with respect to the lamp body 3 and the temporary holding member 4. Note that only one concave-convex lance portion may be provided instead of a plurality as in the first embodiment. In one or more embodiments, however, when a plurality of concave-convex lance portions are provided, a front-rear clamping effect is improved.

The left and right rear end portions of the biasing plate springs (18, 19) curve forward. The distal ends of the biasing plate springs (18, 19) have contact portions (18*a*, 19*a*). The distal ends of the contact portions (18*a*, 19*a*) are formed so as to extend more forward than rear surfaces (16*d*, 17*d*) of the concave portions. Consequently, when the lamp body 3 and the temporary holding member 4 are sandwiched in that order from the front by the concave portions (16*b*, 17*b*), the contact portions (18*a*, 19*a*) are pressed rearward by the rear surface of the temporary holding member 4 and elastically deformed, and the lamp body 3 and the temporary holding member 4 are biased toward the return portions (16*c*, 17*c*), thus preventing looseness of the lamp body 3 and the bulb sockets (5 to 7).

Note that at least one pair of biasing plate springs is provided so as to be generally symmetrical in the up-down or left-right direction about each bulb socket body (5*a* to 7*a*). In addition, the concave-convex lance portions (16, 17) may not have the concave portions (16*a*, 17*a*) and may be lance portions (31, 32) without concave or convex portions as shown in FIG. 7, because the lamp body 3 and the temporary holding member 4 are sandwiched between the biasing plate springs (18, 19) and the return portions (16*c*, 17*c*) so as to position the bulb sockets (5 to 7) in the front-rear direction with respect to the lamp body 3. The concave-convex lance portions (16, 17) and the biasing plate springs (18, 19) also have sufficient strength so as to be capable of sufficiently biasing the lamp body 3 and the temporary holding member 4 and not becoming damaged during attachment to the fixing portions (9 to 11).

Next, an assembly method of the vehicular lamp according to the first embodiment will be described, based on FIGS. 1 to 6.

The vehicular lamp 1 of the first embodiment is formed by pressing the bulb sockets (5 to 7), which are temporarily held to the temporary holding member 4, into the fixing portions (9 to 11) from behind the lamp body 3 integrated with the front cover 2 so as to integratedly fix the bulb sockets (5 to 7) to the fixing portions (9 to 11).

Figure 4:
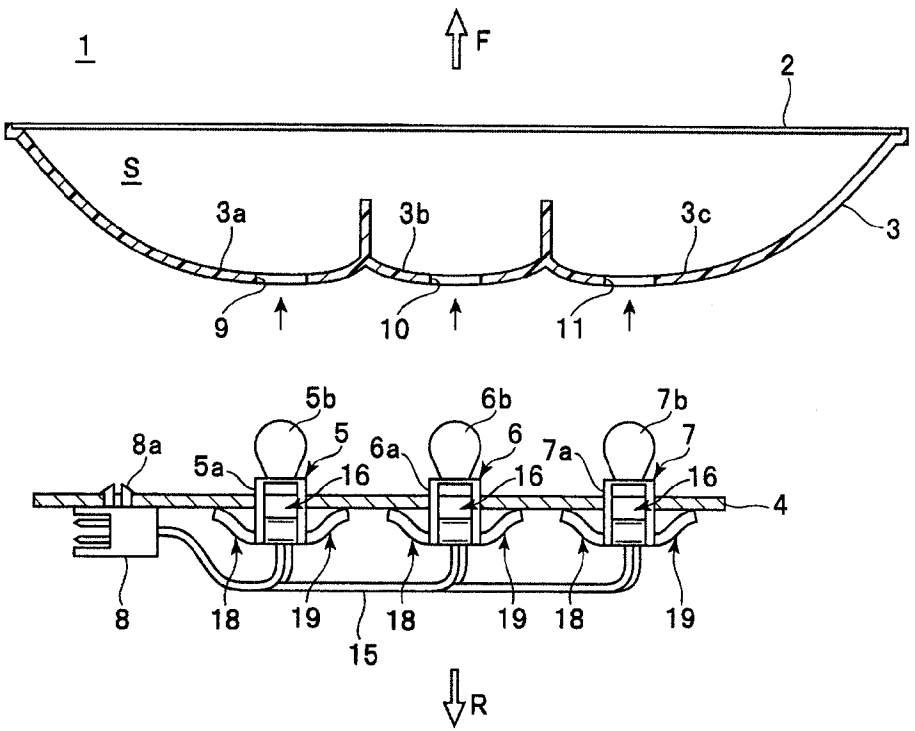
FIG. 4 is an exploded cross-sectional view of the bulb socket temporarily held to the temporary holding member.

To be more specific, first, the bulb sockets (5 to 7) of FIG. 3 are inserted from behind into the temporary holding portions (12 to 14) of the temporary holding member 4, and temporarily held as shown in FIG. 4. Once the bulb sockets (5 to 7) are inserted into the temporary holding portions (12 to 14), the inclined surfaces of the return portions (16*c*, 17*c*) of the concave-convex lance portions (16, 17) contact the upper portions and the lower portions of the vertical holes (12*b* to 14*b*), and the inclined surfaces are thus elastically deformed downward and upward, respectively, around the base end portions. After the return portions (16*c*, 17*c*) pass through the temporarily holding portions (12 to 14), the concave-convex lance portions (16, 17) return to their original positions. At such time, by disposing the opening peripheral edge portions of the temporary holding portions (12 to 14) between the concave portions (16*b*, 17*b*) as shown in FIG. 3, the bulb sockets (5 to 7) are temporarily held in the front-rear direction and also temporarily held to the temporary holding portions (12 to 14). The integrated connector 8 is fixed to the temporary holding member 4 by pressing the front square lance portion 8*a* into the integrated connector attachment portion 4*a*.

Figure 5:
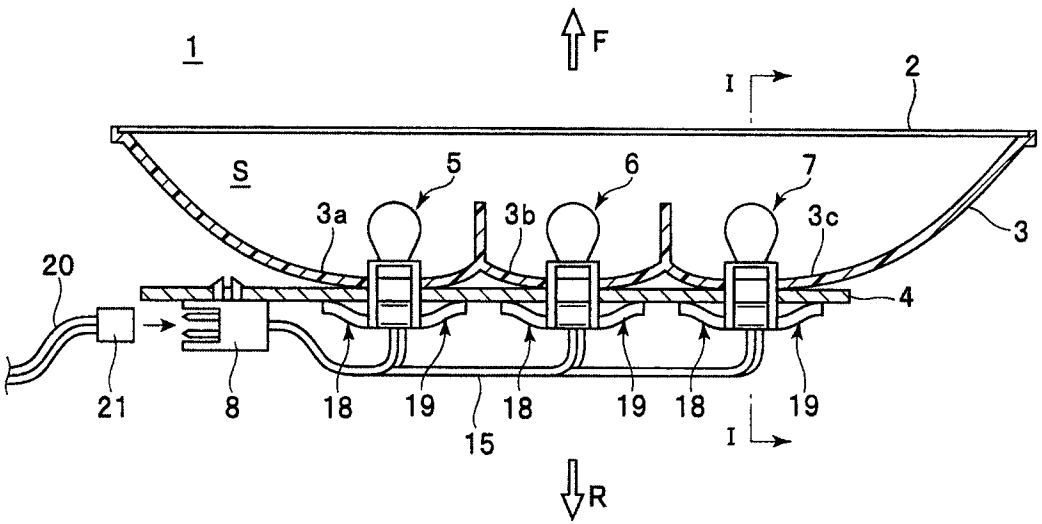
FIG. 5 is a cross-sectional view of the temporarily held bulb socket fixed to the fixing portion of the lamp body.
Figure 6:
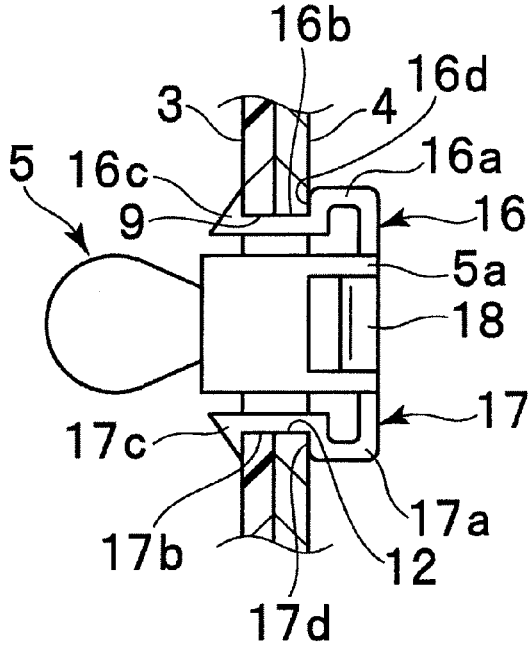
FIG. 6 is a cross-sectional view taken along a line I-I in FIG. 5.

Next, as shown in FIG. 4, the bulb sockets (5 to 7) that are forwardly exposed at the temporary holding portions (12 to 14) of the temporary holding member 4 are pressed into the fixing portions (9 to 11) from behind the lamp body 3 and fixed as shown in FIG. 5. During such pressing, the inclined surfaces of the return portions (16*c*, 17*c*) of the concave-convex lance portions (16, 17) contact the upper portions and the lower portions of the vertical holes (9*b* to lib), and the inclined surfaces are thus elastically deformed downward and upward, respectively, around the base end portions. After the return portions (16*c*, 17*c*) pass through the temporarily holding portions (12 to 14), the concave-convex lance portions (16, 17) return to their original positions and the return portions (16*c*, 17*c*) contact the front surface of the lamp body. At such time, the contact portions (18*a*, 19*a*) of the biasing plate springs (18, 19) are pressed by the rear surface of the temporary holding member 4 and elastically deformed rearward, and the biasing plate springs (18, 19) bias the temporary holding member 4 and the lamp body 3 sandwiched by the concave portions (16*b*, 17*b*) toward the return portions (16*c*, 17*c*).

The bulb sockets (5 to 7) are positioned in the up, down, left, and right directions with respect to the lamp body 3 by fitting the upper, lower, left, and right outer peripheral surfaces of the bulb socket bodies (5*a* to 7*a*) in the horizontal holes (9*a* to 11*a*) of the fixing portions (9 to 11). The bulb sockets (5 to 7) are sandwiched between the concave portions (16*b*, 17*b*) and further sandwiched between the return portions (16*c*, 17*c*) and the biasing plate springs (18, 19), and thus more strongly fixed and further surely positioned in the front-rear direction. Therefore, according to the vehicular lamp of the first embodiment, by providing the concave-convex lance portions (16, 17) and the biasing plate springs (18, 19) on the bulb sockets (5 to 7) temporarily held to the temporary holding member 4, the bulb sockets (5 to 7) can be surely positioned and fixed to the lamp body in a one-touch manner In addition, the integrated connector 8 is mounted with a connector 21 of a power cable 20.

Next, a second embodiment of the vehicular lamp (bulb socket) will be described, based on FIG. 7. A bulb socket 30 according to the second embodiment is common to the bulb sockets (5 to 7) according to the first embodiment in that the bulb socket 30 also has a pair of upper and lower lance portions (31, 32) at the center of the rear end portion on the upper and lower surfaces of a bulb socket body 30*a*. However, the bulb socket 30 is different in that biasing plate springs (33 to 36) are provided in pairs to the left and right of the lance portions (31, 32) on the respective rear end portions of the upper and lower surfaces of the bulb socket 30*a* rather than on the left and right side surfaces of the bulb socket 30*a*. In addition, the lance portions (31, 32) do not have a concave portion similar to the concave-convex lance portions (16, 17), and are configured such that return portions (31*b*, 32*b*) are integrated with the distal ends of plate-like portions (31*a*, 32*a*) that curve forward and extend upward and downward from the rear end portions of the upper and lower surfaces of the bulb socket body 30*a*. The biasing plate springs (33 to 36) curve forward from the rear end portions of the upper and lower surfaces of the bulb socket body 30*a*. The distal ends of the biasing plate springs (33 to 36) have contact portions (33*a* to 36*a*).

The fixing portion on the lamp body side, not shown in the drawings, is formed as a through hole having the same cross shape as in the first embodiment. The horizontal width of the horizontal hole is formed as generally similar to the width of the bulb socket body, and the height of the horizontal hole is formed as generally similar to the height of the bulb socket body. An interval between the resin plate-like portions (31*a*, 32*a*) is formed as generally similar to the height of the vertical hole. A temporary holding portion 38 of a temporary holding member 37 is formed as a cross-shaped through hole that is generally the same size as the fixing portion not shown in the drawings, similar to the first embodiment. The temporary holding portion 38 is formed at the same interval as the fixing portion.

Figure 7A:
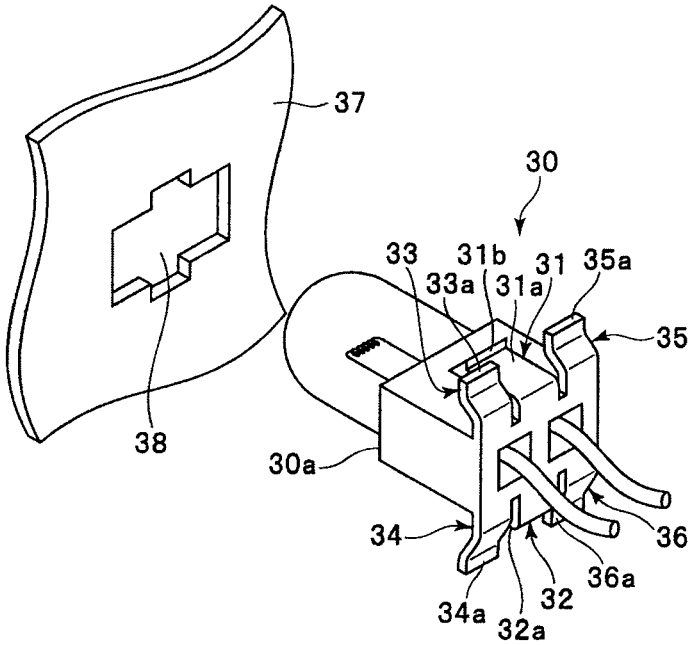
FIG. 7A is a perspective view that shows the bulb socket according to a second embodiment.
Figure 7B:
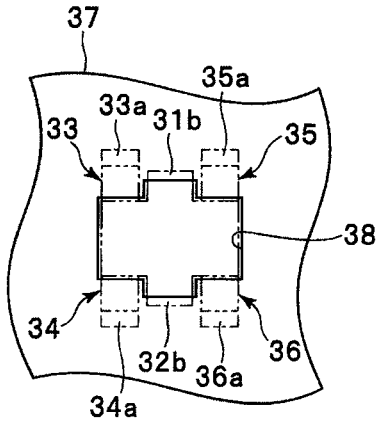
FIG. 7B is a drawing that explains how the bulb socket according to the second embodiment is fixed to the temporary holding member and the lamp body.

The bulb socket 30 of FIG. 7A is inserted from behind into the temporary holding portion 38 of the temporary holding member 37, and temporarily held to the temporary holding portion 38 while forming a minute clearance with the temporary holding portion 38 as shown in FIG. 7B. The bulb socket 30 is held in the front-rear direction by disposing the temporary holding member 37 between the return portions (31*b*, 32*b*) and the contact portions (33*a* to 36*a*) of the biasing plate springs (33 to 36). After the bulb socket 30 forwardly exposed at the temporary holding portion 38 of the temporary holding member 37 is pressed into the fixing portion from behind the lamp body not shown in the drawings, the lance portions (31, 32) of the bulb socket 30 elastically deform downward and upward. In addition, the return portions (31*b*, 32*b*) return to their original positions after passing through the fixing portion, and the return portions (31*b*, 32*b*) contact the front surface of the lamp body not shown in the drawings. The contact portions (33*a* to 36*a*) of the biasing plate springs (33 to 36) are pressed by the rear surface of the temporary holding member 37 and elastically deformed rearward, and the biasing plate springs (33 to 36) bias the temporary holding member 37 and the lamp body not shown in the drawings toward the return portions (31*b*, 32*b*).

The bulb socket 30 is positioned in the left-right direction by fitting the upper, lower, left, and right outer peripheral surfaces of the bulb socket body 30*a* in the horizontal hole of the fixing portion of the lamp body not shown in the drawings, and positioned in the front-rear direction by sandwiching the lamp body not shown in the drawings and the temporary holding member 37 between the return portions (31*b*, 32*b*) and the contact portions (33*a* to 36*a*) of the biasing plate springs (33 to 36), thus positioning and fixing the bulb socket 30 to the lamp body in a one-touch manner.

Next, a third embodiment of the vehicular lamp (bulb socket) will be described, based on FIG. 8. A bulb socket 40 according to the third embodiment has a resin bulb socket body 40*a* whose outer peripheral shape is circular. The rear end portion of the outer peripheral surface of the bulb socket body 40*a* is provided with a pair of upper and lower symmetrical lance portions (41, 42), and a pair of left and right symmetrical biasing plate springs (43, 44). The lance portions (41, 42) are respectively configured such that return portions (41*b*, 42*b*) are integrated with the distal ends of resin plate-like portions (41*a*, 42*a*) that curve forward and extend upward and downward from the rear end portion of the bulb socket body 40*a*, similar to the second embodiment. The biasing plate springs (43, 44) curve forward from the left and right rear end portions of the bulb socket body 40*a*. The distal ends of the biasing plate springs (43, 44) have contact portions (43*a*, 44*a*).

A temporary holding portion 46 of a temporary holding member 45 is formed as a through hole in which symmetrical square hole portions (46*b*, 46*c*) are continuous with the upper and lower sides of a circular hole portion 46*a*. The inner diameter of the circular hole portion 46*a* is slightly larger in diameter than the outer diameter of the bulb socket body 40*a*, and the height between the square hole portions (46*b*, 46*c*) is slightly greater in length than the interval between the upper and lower surfaces of the plate-like portions (41*a*, 42*a*). The width of the square portions (46*b*, 46*c*) is formed slightly wider in length than the left-right width of the lance portions (41, 42). Consequently, the bulb socket 40 inserted into the temporary holding portion 46 defines a minute clearance as shown in FIG. 8B and is temporarily held to the temporary holding portion 46. The fixing portion on the lamp body side, not shown in the drawings, is formed as a through hole in which symmetrical square hole portions are continuous with the upper and lower sides of a circular hole portion, similar to the temporary holding portion 45. However, the inner diameter of the circular hole portion of the fixing portion not shown in the drawings is formed as generally similar to the outer diameter of the bulb socket body 40*a*, and the height between the square hole portions of the fixing portion is formed as generally similar to the interval between the upper and lower surfaces of the plate-like portions (41*a*, 42*a*). The width of the square hole portions is formed as generally similar to the left-right width of the lance portions (41, 42).

Figure 8A:
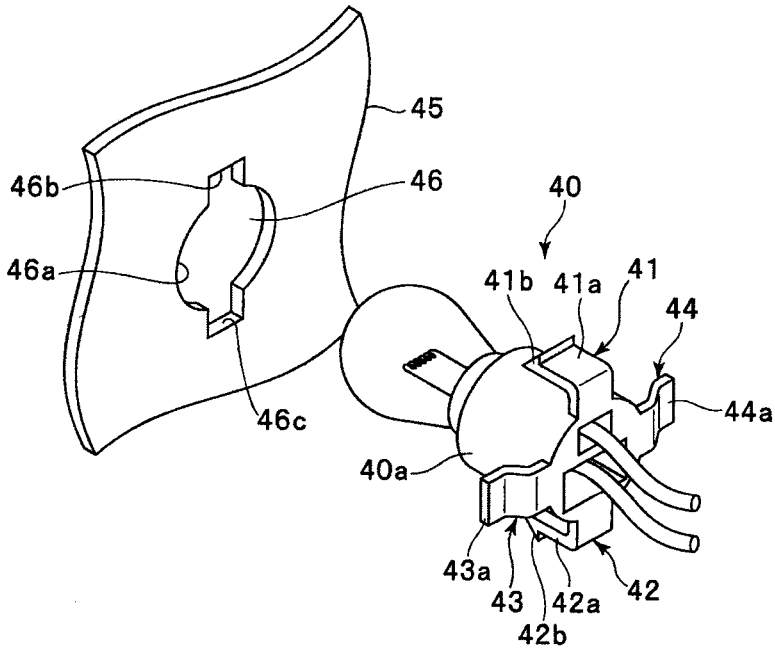
FIG. 8A is a perspective view that shows the bulb socket according to a third embodiment.
Figure 8B:
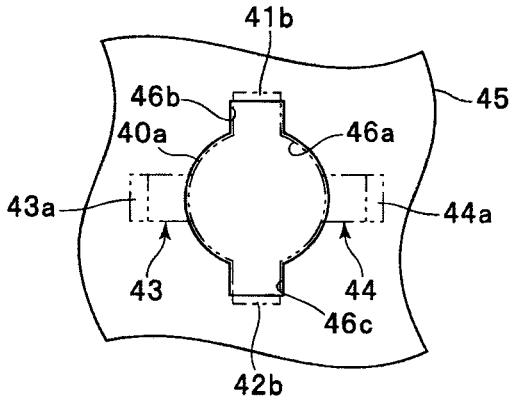
FIG. 8B is a drawing that explains how the bulb socket according to the third embodiment is fixed to the temporary holding member and the lamp body.

The bulb socket 40 of FIG. 8A is inserted from behind into the temporary holding portion 46 of the temporary holding member 45, and temporarily held to the temporary holding portion 46. After the bulb socket 40 forwardly exposed at the temporary holding portion 46 is pressed into the fixing portion from behind the lamp body not shown in the drawings, the lance portions (41, 42) elastically deform downward and upward, respectively, and return to their original positions after passing through the fixing portion. The return portions (41*b*, 42*b*) contact the front surface of the lamp body not shown in the drawings. At such time the contact portions (43*a*, 44*a*) of the biasing plate springs (43, 44) are pressed by the rear surface of the temporary holding member 45 and elastically deformed rearward, and the biasing plate springs (43, 44) bias the temporary holding member 45 and the lamp body not shown in the drawings toward the return portions (41*b*, 42*b*).

Consequently, the bulb socket 40 is positioned with respect to the planar direction of the temporary holding member 45 by fitting the outer peripheral surface of the circular bulb socket body 30*a* into the circular hole portion of the fixing portion of the lamp body not shown in the drawings. In addition, by contacting the lance portions (41, 42) to the square hole portions of the fixing portion not shown in the drawings such that both the left and right end portions of the bulb socket 40 are held, the bulb socket 40 is peripherally held to the temporary holding portion 46. Further, the return portions (41*b*, 42*b*) and the biasing plate springs (43, 44) sandwich the lamp body not shown in the drawings and the temporary holding member 45 to position the bulb socket 40 in the front-rear direction, thus positioning and fixing the bulb socket 40 to the lamp body in a one-touch manner.

Figure 9A:
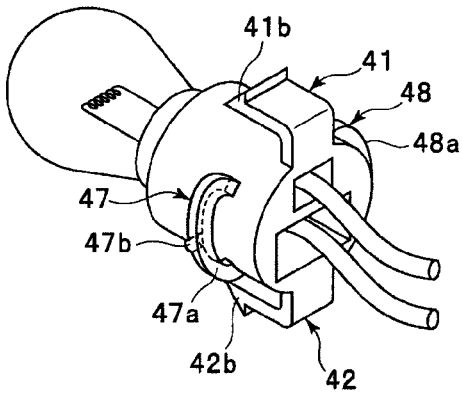
FIG. 9A is a perspective view that shows a modification of biasing plate springs in the bulb socket according to the third embodiment.
Figure 9B:
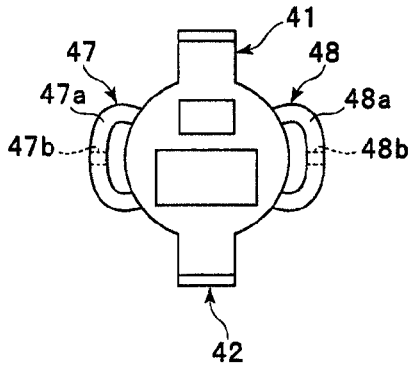
FIG. 9B is a view of the bulb socket of FIG. 9A from behind.

The biasing plate springs (43, 44) of the third embodiment may have a shape such as shown in FIGS. 9A and 9B. Biasing plate springs (47, 48) in FIG. 9 have generally C-shaped plate-like portions (47*a*, 48*a*) that are provided symmetrical in the left-right direction about the center portion of the outer peripheral surface of the bulb socket body 40*a*, and rib-shaped contact portions (47*b*, 48*b*) that are provided projecting forward at the center portions of the plate-like portions (47*a*, 48*a*). After the bulb socket 40 fixed to the temporary holding member 45 is pressed into the fixing portion of the lamp body (not shown), the rib-shaped contact portions (47*b*, 48*b*) are pressed rearward by the rear surface of the temporary holding member 45, and the generally C-shaped plate-like portions (47*a*, 48*a*) are elastically deformed around the base end portion. Consequently, the temporary holding member 45 and the lamp body (not shown) are sandwiched between the lance portions (41, 42) and the rib-shaped contact portions (47*b*, 48*b*), thus positioning and fixing the bulb socket 40 to the lamp body.

While description has been made in connection with exemplary embodiments of the present invention, it will be obvious to those skilled in the art that various changes and modification may be made therein without departing from the present invention. It is aimed, therefore, to cover in the appended claims all such changes and modifications falling within the true spirit and scope of the present invention.

DESCRIPTION OF THE REFERENCE NUMERALS

1 VEHICULAR LAMP
2 FRONT COVER
3 LAMP BODY
4 TEMPORARY HOLDING MEMBER
5 to 7 BULB SOCKET
8 INTEGRATED CONNECTOR
9 to 11 FIXING PORTION
12 to 14 TEMPORARY HOLDING PORTION
16, 17 CONCAVE-CONVEX LANCE PORTION (ELASTIC PORTION)
18, 19 BIASING PLATE SPRING (BIASING MEANS)
100 BULB SOCKET MOUNTING MEANS
30 BULB SOCKET
37 TEMPORARY HOLDING MEMBER
38 TEMPORARY HOLDING PORTION
31, 32 LANCE PORTION (ELASTIC PORTION)
33 to 36 BIASING PLATE SPRING (BIASING MEANS)
40 BULB SOCKET
41, 42 LANCE PORTION (ELASTIC PORTION)
43, 44 BIASING PLATE SPRING (BIASING MEANS)
45 TEMPORARY HOLDING MEMBER
46 TEMPORARY HOLDING PORTION
47, 48 BIASING PLATE SPRING

What is claimed is:

1. A vehicular lamp comprising:
a plurality of bulb sockets, each of the plurality of bulb sockets holding a bulb serving as a light source;
a lamp body that accommodates the bulb sockets;
a front cover that forwardly covers the lamp body;
a plurality of bulb socket fixing portions formed in the lamp body, and inserted with the plurality of bulb sockets;
a temporary holding member that includes a plurality of temporary holding portions of the bulb sockets, and temporarily holds each of the plurality of bulb sockets to each of the plurality of temporary holding portions; and
a bulb socket mounting unit that sandwiches the lamp body and the temporary holding member via an elastic portion formed on each of the bulb sockets,
wherein the elastic portion elastically deforming when the temporarily held bulb sockets are inserted into the fixing portions and returning at predetermined fixing positions of the fixing portions.

2. The vehicular lamp according to claim 1,
wherein the bulb socket mounting unit comprises, on each of the bulb sockets, a biasing unit that biases both the lamp body and the temporary holding member toward the elastic portion at the predetermined fixing positions of the fixing portions.

3. The vehicular lamp according to claim 1,
wherein an integrated connector that integrates and is connected to the plurality of bulb sockets is disposed on the temporary holding member.

4. A vehicular lamp comprising:
a plurality of bulb sockets, each of the plurality of bulb sockets holding a bulb serving as a light source;
a lamp body that accommodates the bulb sockets;
a front cover that forwardly covers the lamp body;

a temporary holding member comprising a plurality of temporary holding portions of the bulb sockets, wherein the temporary holding member temporarily holds each of the plurality of bulb sockets to each of the plurality of temporary holding portions; and a plurality of bulb socket fixing portions formed in the lamp body, and inserted with the plurality of bulb sockets, wherein the plurality of bulb socket temporary holding portions of the temporary holding member is formed at a position that generally matches the plurality of bulb socket fixing portions.

5. An assembly method for a vehicular lamp that includes a plurality of bulb sockets, each of the plurality of bulb sockets holding a bulb serving as a light source; a lamp body that accommodates the bulb sockets; and a front cover that forwardly covers the lamp body, the assembly method comprising:

a first step in which the plurality of bulb sockets is temporarily held to a temporary holding member that is formed with a plurality of temporary holding portions of the bulb sockets;

a second step in which the plurality of bulb sockets temporarily held to the temporary holding member is inserted into a plurality of fixing portions provided in the lamp body, while elastically deforming an elastic portion provided on each of the bulb sockets; and a third step in which the lamp body and the temporary holding member are sandwiched via the elastic portion that returns to an original position thereof at predetermined fixing positions of the fixing portions.

6. The vehicular lamp according to claim 2, wherein an integrated connector that integrates and is connected to the plurality of bulb sockets is disposed on the temporary holding member.

* * * * *